US009649752B1

(12) United States Patent
Garrison

(10) Patent No.: US 9,649,752 B1
(45) Date of Patent: May 16, 2017

(54) FIRE HYDRANT COMBINATION RATCHETING WRENCH/HOOK SPANNER

(71) Applicant: Dennis T. Garrison, Calabasas, CA (US)

(72) Inventor: Dennis T. Garrison, Calabasas, CA (US)

( * ) Notice: Subject to any disclaimer, the term of this patent is extended or adjusted under 35 U.S.C. 154(b) by 0 days.

(21) Appl. No.: 14/474,811

(22) Filed: Sep. 2, 2014

(51) Int. Cl.

| | |
|---|---|
| ***B25B 13/00*** | (2006.01) |
| ***B25B 13/46*** | (2006.01) |
| ***B25B 13/08*** | (2006.01) |
| ***B25B 13/06*** | (2006.01) |
| ***B25B 13/48*** | (2006.01) |
| ***B25B 13/56*** | (2006.01) |
| ***B25B 13/04*** | (2006.01) |
| ***B25B 13/50*** | (2006.01) |

(52) U.S. Cl.
CPC ..... *B25B 13/463* (2013.01); *B25B 13/04* (2013.01); *B25B 13/06* (2013.01); *B25B 13/08* (2013.01); *B25B 13/48* (2013.01); *B25B 13/50* (2013.01); *B25B 13/56* (2013.01)

(58) Field of Classification Search
CPC ..... B25B 13/02; B25B 13/04; B25B 13/06; B25B 13/08; B25B 13/48; B25B 13/50; B25B 13/56; B25B 13/463
USPC ..... 81/124.4; 7/138
See application file for complete search history.

(56) References Cited

U.S. PATENT DOCUMENTS

| | | | | |
|---|---|---|---|---|
| 1,707,856 | A | 4/1929 | Hoffman | |
| 3,292,465 | A | 12/1966 | Mulligan | |
| 3,318,176 | A | 5/1967 | Geier, Jr. | |
| D263,674 | S | 4/1982 | Vlbert | |
| 4,727,782 | A * | 3/1988 | Yang | B25B 13/06 81/124.4 |
| 6,899,001 | B1 * | 5/2005 | Sanders | B25G 1/04 81/125 |
| D598,723 | S * | 8/2009 | Cheng | D8/17 |
| 8,261,635 | B2 | 9/2012 | Lee et al. | |
| 8,739,659 | B2 | 6/2014 | Chen | |
| 2011/0061499 | A1 * | 3/2011 | Franklin | B25B 13/463 81/60 |

* cited by examiner

*Primary Examiner* — Bryan R Muller

(57) ABSTRACT

A combination fire hydrant ratcheting wrench and hook spanner is disclosed that incorporates a wrench body having a number of interchangeable ratchet sockets, hook spanners, spanner indentations and an extendable handle. Such that the wrench sockets may loosen or tighten a pentagonal shaped implement such as a hydrant cap, cover, or valve. Utilizing the hook spanners or spanner indentations the wrench may remove or replace fittings such as reducers and increasers, further the wrench may loosen when connected on a wrench top surface and tighten when connected on a wrench bottom surface.

18 Claims, 5 Drawing Sheets

FIRE HYDRANT COMBINATION RATCHETING WRENCH/HOOK SPANNER

TECHNICAL FIELD

The invention generally pertains to wrenches, and more specifically to a combination fire hydrant wrench that incorporates a plurality of interchangeable ratchet sockets, hook spanners and spanner indentations.

BACKGROUND ART

Previously, many types of ratchet wrenches have been used in endeavoring to provide an effective means for rotating a workpiece, such as a fire hydrant valve.

The prior art listed below did not disclose patents that possess any of the novelty of the instant invention; however the following U.S. patents are considered related:

| U.S. Pat. No. | Inventor | Issue Date |
|---|---|---|
| 3,292,465 | Mulligan | Dec. 20, 1966 |
| 3,318,176 | Geier Jr. | May 9, 1967 |
| Des. 263,674 | Elbert | Jun. 6, 1982 |
| 8,261,635 B2 | Lee et al. | Sept. 11, 2012 |
| 8,739,659 B2 | Chen | Jun. 3, 2014 |

Mulligan in U.S. Pat. No. 3,292,465 teaches a specialized spanner wrench that is used specifically for a vehicle tie rod.

U.S. Pat. No. 3,318,176 issued to Geier Jr. discloses a wrench having a pentagonal socket with notches to permit a square workpiece. The wrench is adjustable to accept a different sized pentagonal workpieces. A revolving handle grip permits rotation of the wrench.

Elbert in U.S. design Pat. Des. 263,674 discloses a combination hydrant spanner and lug wrench. The one piece wrench has a single spanner arm with two tabs spaced apart and a pentagonal cavity in the body. A cylindrical handle extends from a side opposite the spanner arm of the body and a finger groove grip is positioned on the distal end.

Lee et al. in U.S. Pat. No. 8,261,635 B2 teach a one-direction ratchet wrench which has a driving head with a first cavity and a second cavity with pin holes located in the side walls of the second cavity. A ratchet wheel is mounted in the first cavity and a pawl engages the teeth of the wheel to effectively control workpieces in one direction.

U.S. Pat. No. 8,739,659 B2 issued to Chen is for a ratchet wrench having a body with a ratchet surrounded by a hollow center. The ratchet has different recesses on each side permitting alternating large and small workpieces.

For background purposes and as indicative of the art to which the invention is related reference may be made to the remaining cited U.S. Pat. No. 1,707,856 issued to Hoffman.

DISCLOSURE OF THE INVENTION

Above ground fire hydrants have been in use for centuries in most countries and are, at least the United States, relatively standard in their controls. In order to prevent misuse of a hydrant, the valves and even caps typically utilize a pentagonal shaped connection which is designated with a nominal measurement, sometimes referred to as an inch dimension. Since government local requirements often mandate the occurrence and location of fire hydrants some have been in existence for many years and have become difficult to access and use due to corrosion and deterioration.

As there are different sizes and forms of connections in each hydrant, a fire fighter must always have the correct wrench size available. Therefore, the primary object of the invention is to address the need for various pentagonal shaped apertures and spanners in one individual tool. The instant invention functionality of nine single wrenches by including four sockets, three hooks and two tab indentations.

An important aspect of the invention is the use of an extendable handle grip that lengthens the lever arm of the wrench by utilizing a thumb actuated latch mechanism to release or retain its position. The wrench may be carried in the closed position and extended when needed by a fire fighter.

Another attribute of the invention is the use of steel-plated tempered steel which is known for its strength and durability. Many lire hydrants are extremely difficult to access after a long period of disuse and sometimes they may even require a kick or a sudden jolt which is overcome by the wrenches robust nature, Still another feature of the invention is that the wrench utilizes a unidirectional socket rotation which is intuitively obvious in its use. When the wrench's top surface is placed over a pentagonal connection, the wrench permits removal in a counter-clockwise direction, and when the wrench is turned on its bottom surface, clockwise rotation allows replacement. No lever is required to change rotation of the ratchet socket.

Yet another feature of the invention is the ease of component replacement by simply removing the wrench's cover screws with a conventional screwdriver, thereby exposing the ratchet sockets and pawls.

A further aspect of the invention is that the wrench has no sharp edges and is ergonomically designed, which reduces injury due to awkward in-service positions requiring pulling, pushing or kicking.

A final attribute of the invention is the cost savings that is achieved by replacing nine tools with one combination wrench complete with spanners.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
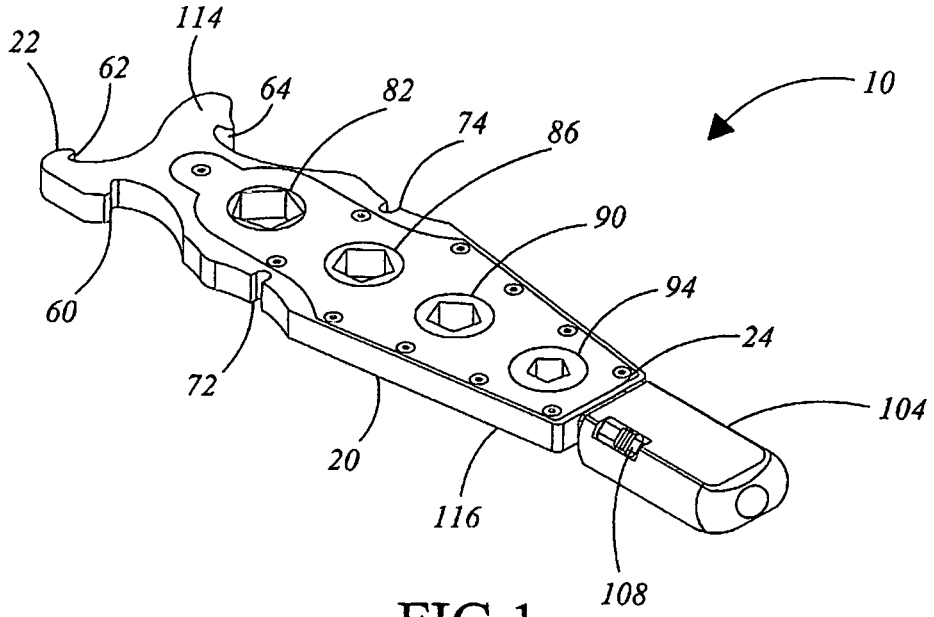
FIG. 1 is a partial isometric view of the combination fire hydrant ratcheting wrench and hook spanner in the preferred embodiment.
Figure 2:
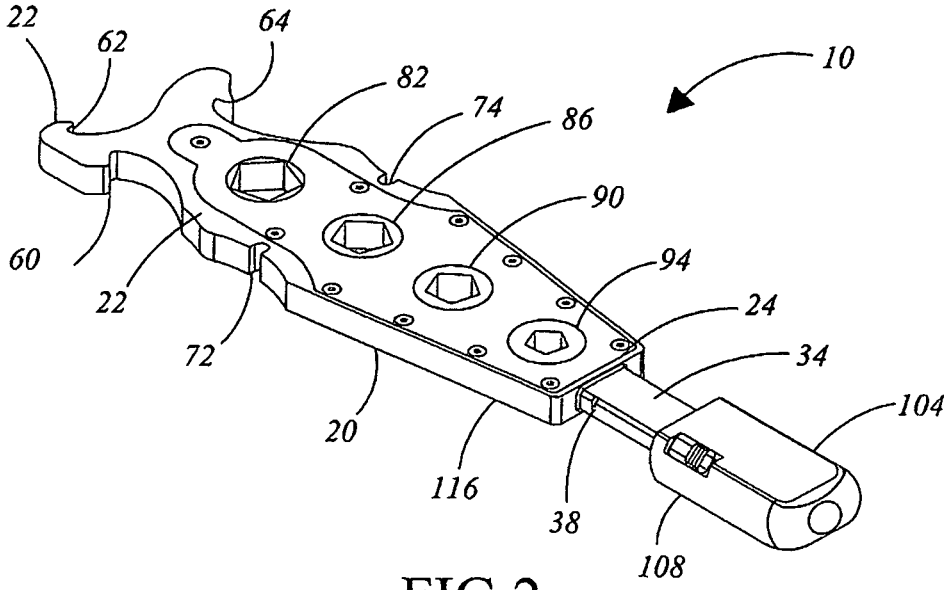
FIG. 2 is a partial isometric view of the combination fire hydrant ratcheting wrench and hook spanner with the handle grip extended of the preferred embodiment.

The best mode for carrying out the invention is presented in terms that disclose a preferred embodiment of a fire hydrant, combination ratcheting wrench and hook spanner. This preferred embodiment, is shown in FIGS. 1 through 9, and is comprised of a combination fire hydrant ratcheting wrench and hook spanner 10, for use on a fire hydrant 12, and is comprised of a wrench body 20 having a top 22, a bottom 24, a left side 26, a right side 28 and a lower portion 30. The top 22 has a cover recess 32 and an outwardly extending handle 34 on the body lower portion 30.

Figure 3:
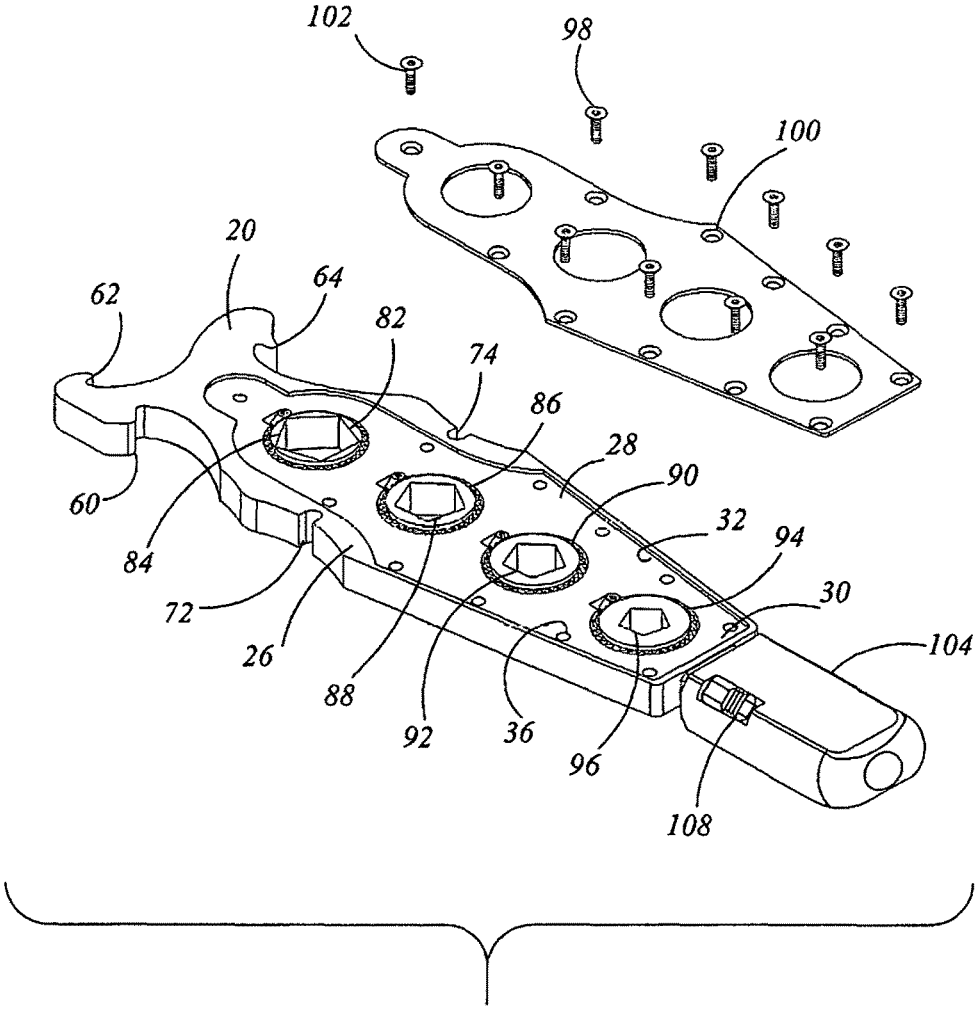
FIG. 3 is a partial exploded isometric view of the combination fire hydrant ratcheting wrench and hook spanner illustrating the complete body with the cover and attaching screws removed, in the preferred embodiment.
Figure 4:
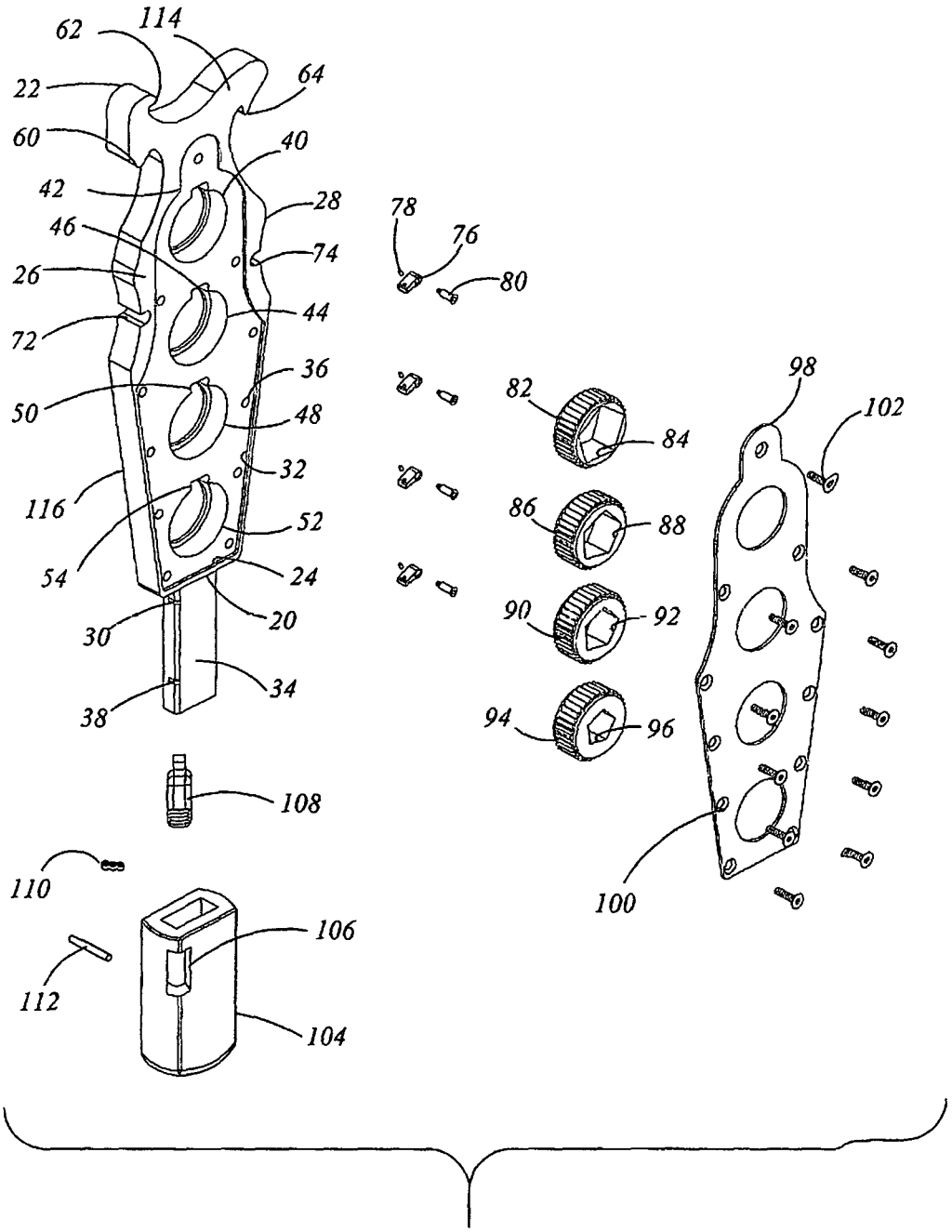
FIG. 4 is an exploded view of the combination fire hydrant ratcheting wrench and hook spanner in the preferred embodiment.
Figure 5:
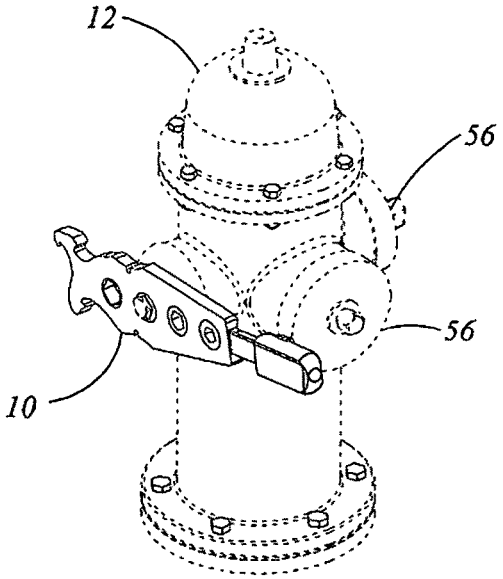
FIG. 5 is an isometric view of the combination fire hydrant ratcheting wrench and hook spanner opening a valve on a fire hydrant with a ratcheting socket. The fire hydrant is illustrated dashed as it is only the workpiece.

The wrench body 20 is made of plated steel and includes a number of cover tapped holes 36 in the cover recess 32, as illustrated in FIGS. 3 and 4. The wrench body outwardly extending handle 34 has a rectangular configuration and includes at least two handle lock notches 38, as shown best in FIG. 4.

The wrench body 20 incorporates a first flanged circular hollow cavity 40, a second flanged circular hollow cavity 44, a third flanged circular hollow cavity 48, and a fourth recessed flanged circular hollow cavity 52. The above cavities contain a mating first pawl depressed indention with a threaded hole 42, a second pawl depressed indention with a threaded hole 46, a third pawl depressed indention with a threaded hole 50, and a fourth pawl depressed indention with a threaded hole 54, as depicted in FIG. 4. The flanged element of each cavity is defined as an inwardly facing protrusion at the underside portion of the wrench bottom. The protrusion is wide enough to interface with the edge of a ratchet socket for retention purposes on the body's bottom 24.

Figure 6:
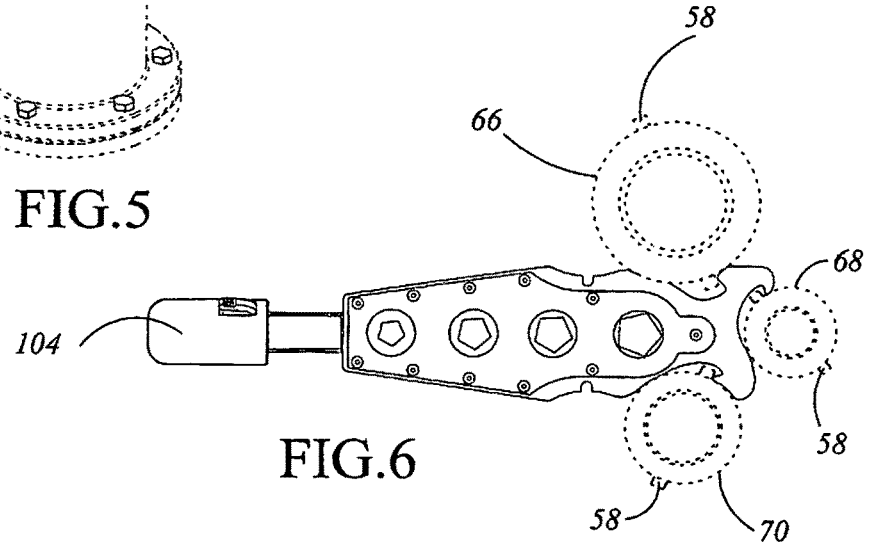
FIG. 6 plan view of the combination fire hydrant ratcheting wrench and hook spanner illustrating a four inch cap, a one and one-half inch cap and a two and one-half inch cap on the appropriate hook spanner. The caps are illustrated dashed as they are the workpiece.

In order to loosen or tighten a cap or a fitting 56 that incorporates outwardly extending tabs 58, the wrench body 20 contains three integrally shaped hooks consisting of a first hook spanner 60 on a portion of the body's left side 26, a second hook spanner 62 on a portion of said body's top 22, and a third hook spanner 64 which is on a portion of said body's right side 28, as illustrated in FIGS. 1-4. The first hook spanner 60 is preferably sized to interface with a tab 58 of a four inch cap or fitting 66. The second hook spanner 62 is preferably sized to interface with a tab 58 of a one and one half inch cap or fitting 68, and the third hook spanner 64 is preferably sized to interface with a tab 58 of a two and one half inch cap or fitting 70, as depicted in FIG. 6.

Figure 7:
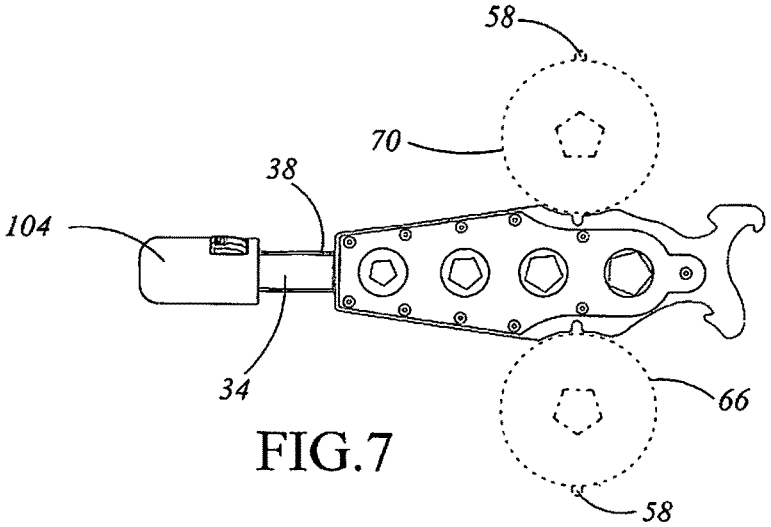
FIG. 7 plan view of the combination fire hydrant ratcheting wrench and hook spanner illustrating a four inch cap and a two and one-half inch cap on the appropriate indentation spanner. The caps are shown dashed as they are the workpiece.
Figure 8:
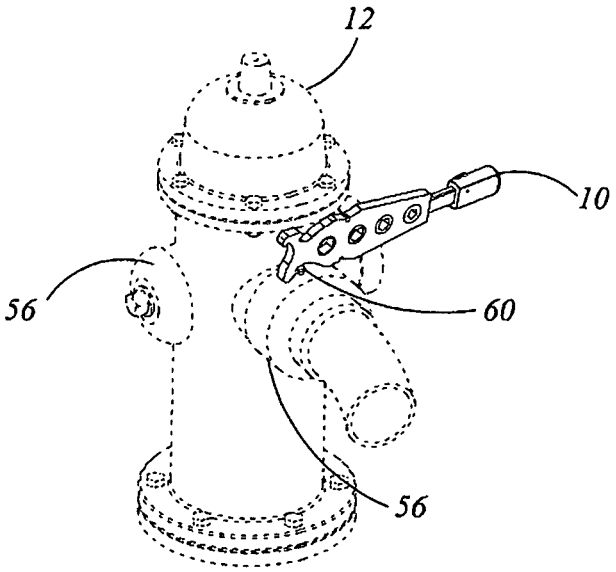
FIG. 8 is an isometric view of the combination fire hydrant ratcheting wrench and hook spanner attaching a hose on a workpiece tire hydrant with a hook spanner.
Figure 9:
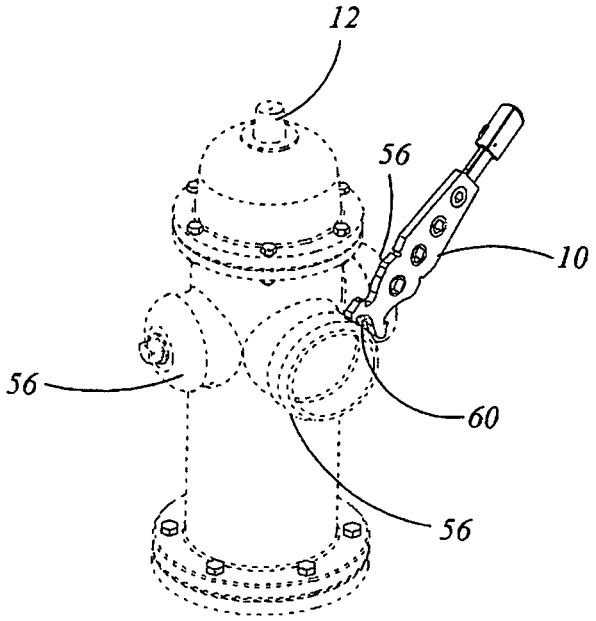
FIG. 9 is an isometric view of the combination fire hydrant ratcheting wrench and hook spanner attaching a fitting on a workpiece fire hydrant with a hook spanner.

An alternate ability to tighten a cap or a fitting 56 incorporates two additional spanner configurations, a first spanner indentation 72 located on the body's left side 26, and a second spanner indentation 74 located on the body's right side 28, as shown in FIG. 7. The first spanner indentation 72 is preferably sized to interface with a tab 58 of a two and one half inch cap or fitting. The second spanner indentation 74 is preferably sized to interface with a tab 58 of a four inch cap or fitting 66.

A ratchet pawl 76 is positioned within in each pawl depressed indention 42, 46, 50 and 54. A ratchet spring 78 pre-loads the ratchet pawl 76 and a pawl screw 80 rotatably positions the pawl 76 within each depressed indention 42, 46, 50 and 54, as depicted in FIG. 4.

A first interchangeable ratchet socket 82 with peripheral teeth is located within the body's first recessed flanged circular hollow cavity 40 and preferably has a pentagonal shaped one and one quarter inch hollow aperture 84 therethrough, A second interchangeable ratchet socket 86 with peripheral teeth is located within the body's second recessed flanged circular hollow cavity 44 and preferably has a pentagonal shaped seven eighth inch hollow aperture 88 therethrough, A third interchangeable ratchet socket 90 with peripheral teeth is located within the body's third recessed flanged circular hollow cavity 48 and preferably has pentagonal shaped five eighth inch hollow aperture 92 therethrough, A fourth interchangeable ratchet socket 94 with peripheral teeth is located within the body's fourth recessed flanged circular hollow cavity 52, and preferably has a pentagonal shaped one half inch hollow aperture 96 therethrough, The above ratchet sockets are interchangeable, in order from upper to lower of the hollow apertures or may be replaced with other configurations according to the needs of the fire district or area.

A cover 98, located within the cover recess 32, has a plurality of cover attaching holes 100. The cover 98 is fastened to the body 20 with wrench cover screws 102 that are inserted through attaching holes 100 into the cover tapped holes 36, as illustrated in FIGS. 1-4, 6 and 7.

A handle grip 104 slideably encompasses the outwardly extending handle 34 and includes a handle grip latch assembly adjustment means. The grip 104 has a latch opening 106 on an upper portion thereof, a spring-loaded latch assembly 108, which includes a latch spring 110 within the latch opening 106, and a latch pin 112 that retains the latch assembly 108 in the latch opening 106.

The handle grip 104 is locked in place when it simultaneously contacts the wrench body 20 and interfaces with the top handle lock notch 38. For a fully open position, the handle grip 104 embraces the lower handle lock notch 38 and is controlled by the latch assembly 108 which is spring-loaded to lock into the notch 38 and unlock when manually depressed. It is anticipated that a plurality of notches 38 could also be utilized to permit intermediate locked positions.

During operation the combined ratcheting wrench 10 may loosen or tighten pentagonal shaped implements, such as hydrant caps or valves, by utilizing the ratchets. To remove or replace fittings such as reducers and increasers, the combined ratcheting wrench 10 employs the spanner hooks or spanner indentations formed with the body. The position of the wrench may loosen when connected on a wrench top surface 114 and tighten when connected on wrench bottom surface 116.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. A combination fire hydrant ratcheting wrench and hook spanner which comprises;

a wrench body having a top, a bottom, a left side, a right side, an upper end and a lower end, wherein said top having a cover recess and an outwardly extending handle on said body's lower portion, said wrench body having a first, a second, a third and a fourth recessed flanged circular hollow cavity, wherein each recessed flanged circular hollow cavity having a ratchet pawl therein, a first hook spanner shaped integral with a portion of said body left side, a second hook spanner shaped integral with a portion of said upper end, a third hook spanner shaped integral with a portion of said body right side, a portion of said body left side having a first spanner indentation therein, a portion of said body right side having a second spanner indentation therein, a plurality of interchangeable ratchet socket having peripheral teeth located within each of said respective body recessed flanged circular hollow cavities, a cover located within said cover recess, and a handle grip slideably encompassing said outwardly extending handle, such that said ratcheting wrench may loosen or tighten a pentagonal shaped implement such as a hydrant cap or a valve utilizing the ratchets, wherein removing or replacing fittings such as, reducers and expanders, employs the spanner hooks or spanner indentation within said body, wherein each of said interchangeable ratchet sockets engage with the respective ratchet pawls for rotation in a directions that may loosen a threaded member when engaged with said threaded member through a wrench top surface and tighten said threaded member when engaged with said threaded member through a wrench bottom surface.

2. A combination fire hydrant ratcheting wrench and hook spanner which comprises;

a) a wrench body having a top, a bottom, a left side, a right side, an upper end and a lower end, wherein said top having a cover recess and an outwardly extending handle on said body lower portion, wherein said wrench body having a first, a second, a third and a fourth recessed flanged circular hollow cavity each containing a pawl receiving indention, b) a first hook spanner shaped integrally with a portion of said body left side, c) a second hook spanner shaped integrally with a portion of said upper end, d) a third hook spanner shaped integrally with a portion of said body right side, e) a portion of said body left side having a first spanner indentation therein, f) a portion of said body right side having a second spanner indentation therein, g) a ratchet pawl located within in each body pawl receiving indention, h) a first interchangeable ratchet socket having peripheral teeth located within each of said respective body recessed flanged circular hollow cavities, i) a second interchangeable ratchet socket having peripheral teeth located within said body second recessed flanged circular hollow cavity, j) a third interchangeable ratchet socket having peripheral teeth located within said body third recessed flanged circular hollow cavity, k) a fourth interchangeable ratchet socket having peripheral teeth located within said body fourth recessed flanged circular hollow cavity, l) a cover located within said cover recess, and m) a handle grip slideably encompassing said outwardly extending handle and having latch assembly adjustment means such that said combined ratcheting wrench may loosen or tighten a pentagonal shaped implement, such as a hydrant cap or a valve, by utilizing the ratchets, wherein removing or replacing fittings such as reducers and increasers employs the spanner hooks or spanner indentations within said body, wherein each of said interchangeable ratchet sockets engage with the respective ratchet pawls for rotation in a directions that may loosen a threaded member when engaged with said threaded member through the wrench top surface, and tighten said threaded member when engaged with said threaded member through a wrench bottom surface.

3. The combination fire hydrant ratcheting wrench and hook spanner as recited in claim 2 wherein said wrench body is comprised of plate steel.

4. The combination fire hydrant ratcheting wrench and hook spanner as recited in claim 2 wherein said wrench body cover recess having a plurality of cover tapped holes therein.

5. The combination fire hydrant ratcheting wrench and hook spanner as recited in claim 2 wherein said wrench body outwardly extending handle further having a rectangular configuration.

6. The combination fire hydrant ratcheting wrench and hook spanner as recited in claim 2 wherein said wrench body outwardly extending handle having a plurality of handle lock notches.

7. The combination fire hydrant ratcheting wrench and hook spanner as recited in claim 2 wherein each pawl is unidirectional and each pawl depressed indention having a pawl screw threaded hole therein.

8. The combination fire hydrant ratcheting wrench and hook spanner as recited in claim 2 wherein said first hook spanner has a configuration that interfaces with a tab of a four inch cap or fitting.

9. The combination fire hydrant ratcheting wrench and hook spanner as recited in claim 2 wherein said, second hook spanner has a configuration that interfaces with a tab of a one and one half inch cap or fitting.

10. The combination fire hydrant ratcheting wrench and hook spanner as recited in claim 2 wherein said third hook spanner has a configuration that interfaces with a tab of a two and one half inch caps and fittings.

11. The combination fire hydrant ratcheting wrench and hook spanner as recited in claim 2 wherein said first spanner indentation is sized to engage a tab of a four inch plastic cap.

12. The combination fire hydrant ratcheting wrench and hook spanner as recited in claim 2 wherein said second spanner indentation is sized to engage a tab of a two and one half inch plastic cap.

13. The combination fire hydrant ratcheting wrench and hook spanner as recited in claim 2 wherein said first ratchet socket having a pentagonal shaped one and one quarter inch hollow aperture therethrough.

14. The combination fire hydrant ratcheting wrench and hook spanner as recited in claim 2 wherein said second ratchet socket having a pentagonal shaped seven eighth inch hollow aperture therethrough.

15. The combination fire hydrant ratcheting wrench and hook spanner as recited in claim 2 wherein said third ratchet socket having a pentagonal shaped five eighth inch hollow aperture therethrough.

16. The combination fire hydrant ratcheting wrench and hook spanner as recited in claim 2 wherein said fourth ratchet socket having a pentagonal shaped one half inch hollow aperture therethrough.

17. The combination fire hydrant ratcheting wrench and hook spanner as recited in claim 2 wherein said ratcheting wrench cover is attached to said wrench body with a plurality of wrench cover screws.

18. The combination fire hydrant ratcheting wrench and hook spanner as recited in claim 2 wherein said handle grip latch assembly adjustment means is comprised of said grip handle having a latch opening on an upper portion of said handle grip, a spring-loaded latch assembly including a latch spring within said latch opening, and a latch pin retaining latch said latch assembly in said latch opening.

* * * * *